United States Patent [19]

George

[11] Patent Number: 4,601,492

[45] Date of Patent: Jul. 22, 1986

[54] RELEASABLE COUPLING

[75] Inventor: Flint R. George, Katy, Tex.

[73] Assignee: Geo Vann, Inc., Houston, Tex.

[21] Appl. No.: 435,458

[22] Filed: Oct. 20, 1982

[51] Int. Cl.[4] ..... F16L 37/08

[52] U.S. Cl. ..... 285/3; 285/18; 285/39; 285/315; 285/319; 285/306; 137/68.1; 166/318

[58] Field of Search ..... 285/3, 18, 306, 39, 285/315, 319, 339; 166/321, 318, 319; 137/68 R, 71, 69, 70

[56] References Cited

U.S. PATENT DOCUMENTS

| | | | |
|---|---|---|---|
| 2,228,243 | 12/1939 | Baker | 166/1 |
| 2,839,315 | 6/1958 | Arterbury | 285/3 |
| 3,148,894 | 9/1964 | Schwab | 285/3 |
| 3,331,378 | 7/1967 | Gibbs et al. | 137/68 R |
| 3,888,306 | 6/1975 | Wetzel | 166/255 |
| 4,066,282 | 1/1978 | Vann | 285/39 |
| 4,175,778 | 11/1979 | Nunez et al. | 285/3 |
| 4,292,988 | 10/1981 | Montgomery | 137/68 R |
| 4,449,736 | 5/1984 | Blackwell | 285/3 |
| 4,452,472 | 6/1984 | Crase | 285/3 |

*Primary Examiner*—Cornelius J. Husar
*Assistant Examiner*—Eric K. Nicholson
*Attorney, Agent, or Firm*—James R. Duzan

[57] ABSTRACT

A releasable coupling has opposite ends adpated to be connected into a tool string or tubing string and run downhole into a borehole. A sealing member is passed down through the tubing string and allowed to become seated within the axial passageway of the releasable coupling. Pressure is applied through the axial passageway above the sealing member whereupon the differential in pressure effected across the sealing member is also effected across a slidable piston reciprocatingly received within the releasable coupling. The piston moves into a position which enables a male member to be released and separated from a female member. When the male and female members are released and separated from one another, the lower part of the tubing string is disconnected from the upper part of the tubing string.

8 Claims, 7 Drawing Figures

RELEASABLE COUPLING

REFERENCE TO RELATED APPLICATIONS

This application is related to the releasable coupling disclosed in copending United States Application Ser. No. 175,515, filed Aug. 5, 1980, entitled "Ball Switch Device and Method" and owned by the assignee of the present invention.

BACKGROUND OF THE INVENTION

In Vann U.S. Pat. No. 4,040,482, U.S. Pat. No. 4,066,282 and U.S. Pat. No. 3,966,236, it is pointed out that one often can foresee that the lower part of a tool string or tubing string subsequently must be disconnected from the remainder of the string. This is especially so in well completion work wherein the lower portion of the tubing string must sometimes be severed by employment of explosive devices, and the severed lower portion of the string dropped to the bottom of the hole.

Various different tubing release couplings have been proposed as evidenced by the above mentioned patents. In the prior art tubing release couplings, it is necessary to run a tool downhole on the end of a slick line or wireline in order to mechanically release the coupling, and this is objectionable for several reasons. There is always a possibility that the wireline tool could become stuck downhole in the borehole, thereby necessitating a costly fishing job. Moreover, it is often difficult to mechanically shift prior art release mechanisms with a wireline tool in deviated well bores that are not vertical or not straight. Some well bores have multiple curves, such as S-shapes or the like, for example, slanting 50 degrees from vertical, followed by slanting 20 or 30 degrees in another direction. Other well bores might be relatively straight, but highly angled or deviated from vertical. In such curved or highly angled well bores, physically manipulating the prior art wireline-type release tools in order to engage the release mechanism of the releasable coupling is often a problem. In particular, it is most difficult to pass a wireline tool down a deviated well since the wireline has no rigidity. In addition, sometimes such prior art releasable couplings are accidentally or prematurely tripped or released by other tools, such as logging tools, being run up and down the well bore through the releasable coupling, both in such curved or deviated well bores and in well bores that are relatively straight and vertical, which again would necessitate a costly fishing job.

A release coupling which avoids the difficulties experienced with prior art releasable couplings and which is manipulated by passing a sealing member down the axial passageway of the pipe string and thereafter applying pressure through the axial passageway above the sealing member is the subject of the present invention.

SUMMARY OF THE INVENTION

The present invention overcomes the problems experienced with prior art releasable couplings by providing a dependable, efficient releasable coupling that is actuated without the use of a wireline. The releasable coupling of the present invention allows the capability of running other tools, such as logging tools, fishing tools, or other types of wireline tools, back and forth through the coupling, and further allows a bar to be dropped through the releasable coupling, for example for detonating a perforating gun, without accidentally triggering the release mechanism to prematurely separate the lower portion of the tubing string from the upper portion. The invention has particular advantages, for example, in multiple-curved or highly deviated well bores as described above. It will be appreciated, however, that this releasable coupling will also provide efficient, reliable service in wells that are relatively straight and relatively vertical.

This invention sets forth a releasable coupling which can be interposed within a tool string or tubing string for subsequently parting the string at a predetermined location along its length by passing a sealing member, such as a ball, down the axial passageway of the string and thereafter applying pressure to the upper end of the string. The releasable coupling of the present invention includes a female member which telescopingly receives a male member therewithin. One end of each of the members terminates in a threaded surface by which the members are connected into the tool string or tubing string. The telescoping end portions of the male and female members cooperate to form load transferring members which are held together by a slidable piston. A sleeve positioned inwardly of the load transferring members forms a piston working chamber. The load transferring members, piston and sleeve are concentrically arranged with respect to one another.

The longitudinal axial passageway of the releasable coupling of the invention is formed in part by the sleeve and is reduced in inside diameter in a downward direction so that a sealing member of the appropriate size comes to rest along the lower portion of the axial passageway. In one embodiment of the present invention, a pilot passageway is formed through the sidewall of the sleeve at a location above the sealing member and at the upper extremity of the working chamber. In such embodiment, a lower bleed port is formed through the sleeve at a location below the sealing member and at the lower end of the working chamber. Pressure applied at the upper end of the string cannot be transmitted past the sealing member, but instead, is transmitted through the upper pilot passageway and is applied to the upper end of the working chamber, thereby driving the piston in a downward direction. Fluid captured below the piston escapes through the bleed port below the sealing member. In another embodiment of the present invention, a pilot passageway is formed through the sidewall of the sleeve at a location above the sealing member and at the lower extremity of the working chamber. In this alternative embodiment, an upper bleed port is formed through the sidewall of the female member at a location above the sealing member and the pilot passageway and at the upper extremity of the working chamber. Pressure applied at the upper end of the string cannot be transmitted past the sealing member, but instead, is transmitted through the lower pilot passageway and is applied to the lower end of the working chamber, thereby driving the piston in an upward direction. Fluid captured above the piston escapes through the upper bleed port into the annulus of the borehole. Accordingly, the pressure differential effected across the sealing member is also effected across the piston, thereby driving the piston downwardly, in the first embodiment of the present invention, or upwardly, in the second or alternative embodiment of the present invention, which action releases the restraining force holding the male member against the female member. Consequently, the male and female members telescope apart, thereby releasing the lower end of the string from the upper end of the string.

The upper end portion of the male member is provided with means on its exterior surface which releasably engage cooperative means on the interior surface of a medial portion of the female member. The upper end portion of the male member is provided with a number of circumferentially positioned, longitudinally extending slots which form elongated fingers therebetween, with there being interengageable teeth in the form of, for example, a threaded surface, located on the outside surface of the fingers and on the inside surface of the female member. The piston is slidably received against the inside surface of the fingers, thereby preventing inward movement of the fingers and preventing the threaded confronting surfaces of the male and female members from disengaging from one another. When the piston is reciprocated either upwardly or downwardly, as the case may be, the fingers are free to move away from the female member, thereby permitting the disengagement of the teeth and allowing the male and female members to be telescoped apart.

Accordingly, a primary object of the present invention is the provision of a releasable coupling apparatus by which a pipe string can be parted at a predetermined location along its length.

Another object of the invention is to provide a downhole tool comprised of a male and female member telescopingly received one within the other, and a piston slidably received within the male member, wherein the male and female members are held fastened to one another by the presence of the piston, and when the piston is reciprocated longitudinally of the borehole, the male and female members telescopingly move apart.

A further object of this invention is to disclose and provide a pressure actuated releasable coupling member which parts a pipe string at a predetermined location by passing a sealing member downhole and thereafter applying pressure to the axial passageway above the sealing member.

A still further object of this invention is to disclose a releasable coupling apparatus which connects together an upper and lower pipe string, and which includes upper and lower members which part from one another upon the development of a pressure differential across the releasable coupling apparatus.

These and various other objects and advantages of the invention will become readily apparent to those skilled in the art upon reading the following detailed description and claims and by referring to the accompanying drawings.

The above objects are attained in accordance with the present invention by the provision of apparatus fabricated in a manner substantially as described in the above abstract and summary.

DETAILED DESCRIPTION OF THE PREFERRED EMBODIMENTS

Figure 1:
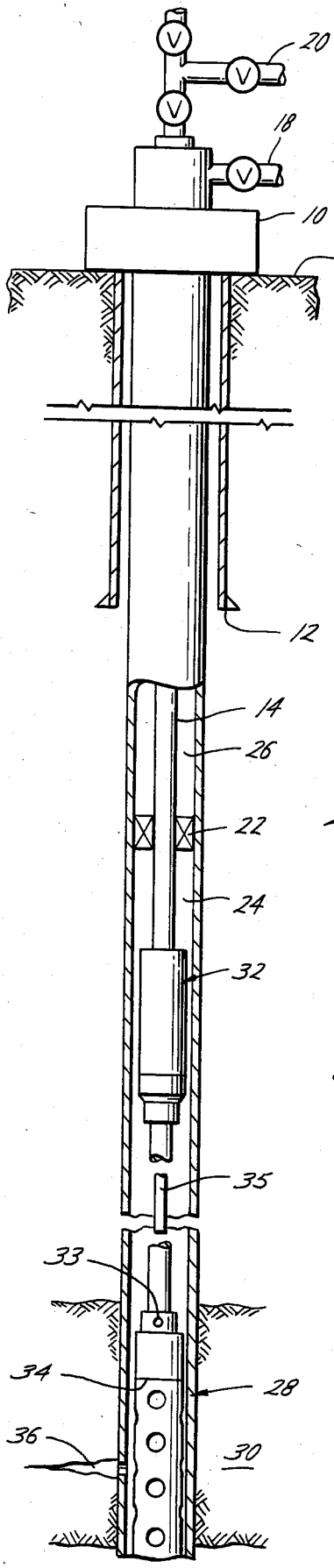
FIG. 1 is a partly diagrammatic, partly schematic, partly cross-sectional fragmentary view of a wellbore formed within the earth, with there being a tool string supported within the wellbore having an apparatus made in accordance with the present invention included therein.
Figure 3:
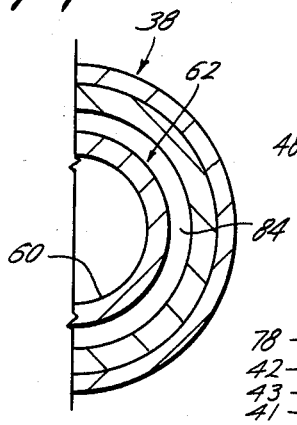
FIG. 3 is a transverse, cross-sectional view taken along line 3—3 of FIG. 2A.

FIG. 1 discloses a wellhead 10 located at the top of a cased borehole 12, with there being a pipe or tubing string 14 located concentrically within the well. The wellhead extends above the surface 16 of the ground, and includes outflow pipes 18 and 20 with there being suitable valves connected thereto to provide a structure which usually is referred to as a Christmas tree.

A packer device 22 divides the borehole annulus into a lower annular area 24 and an upper annular area 26. The tool string, for purposes of illustration, disposed on the end of pipe string 14, includes a casing type jet perforating gun 28, as seen, for example, in the Vann U.S. Pat. No. 4,140,188. The gun is positioned adjacent to a formation 30, also called a pay zone.

A releasable coupling 32, made in accordance with the present invention, is included within the pipe string for subsequently parting the string at the location of the coupling. A gun firing head 34 detonates the shaped charges of the gun when a weighted bar 35 is dropped down through the interior of the pipe string. Numeral 36 indicates one of a plurality of tunnels formed back up into the formation by the action of the shaped charge.

Referring now to the first embodiment of the present invention as particularly disclosed in FIGS. 2A, 2B, 3, and 4, such first embodiment includes a main body 38 having an upper threaded box end 40 and a lower end 42. The main body 38 is hereinafter referred to as a female member. A male member 44 forms the lower end of the releasable coupling. The lower end of the male member is provided with a threaded pin 46. The male member has an upper length telescopingly received within a lower length of the female member. A metal ring of mild steel is disposed around male member 44 between shoulder 41 and the lower end 42 of main body 38. Slots 45, 47 are provided in shoulder 41 and end 42. Upon assembly, a hammer and punch are used to bend the metal ring into slots 45, 47 to prevent relative rotation between the male and female members. Alternatively, a set screw 43 (FIG. 2A) serves the same purpose as the metal ring.

Figures 2A, 2B:
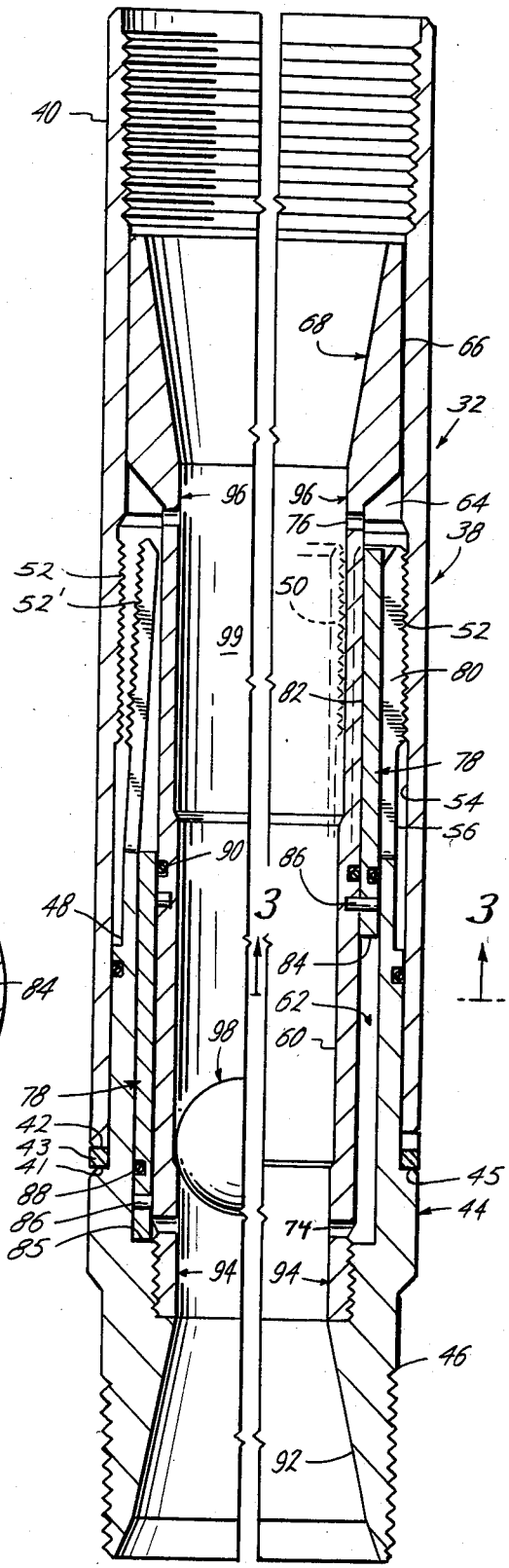
FIG. 2A is an enlarged, longitudinal, cross-sectional view of the first embodiment of the releasable coupling of the invention with the male member lockingly engaged within the female member prior to the sealing member being seated within the axial passageway of the sleeve and pressure applied through the axial passageway above the releasable coupling.
FIG. 2B is an enlarged, longitudinal, cross-sectional view of the apparatus of FIG. 2A after the sealing member has been seated within the axial passageway of the sleeve and pressure applied through the axial passageway of the string above the releasable coupling, thereby driving the piston downwardly away from the teeth on the male and female members.
Figure 4:
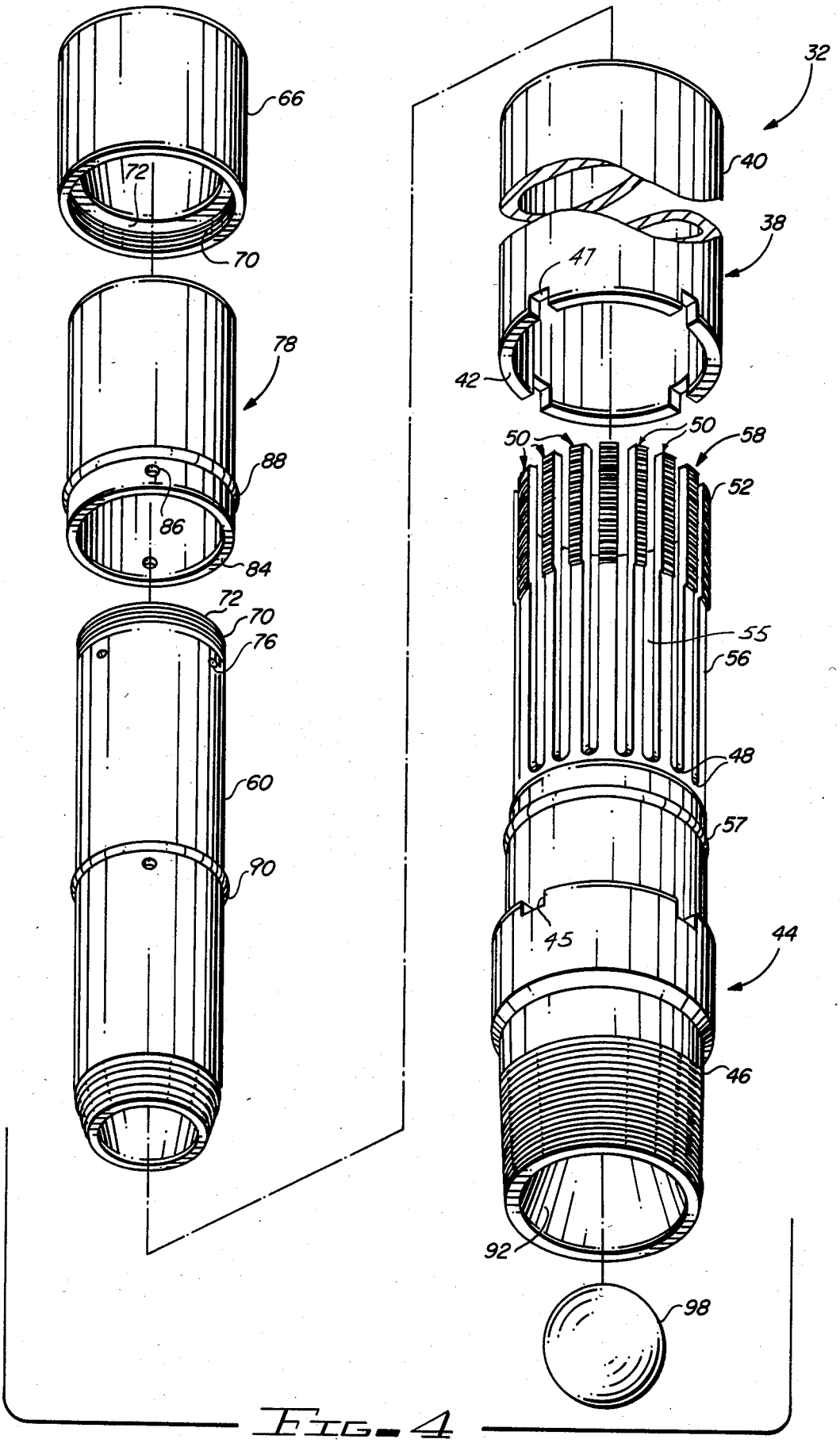
FIG. 4 is an exploded view of the apparatus of FIGS. 2A and 2B.

As best seen in FIG. 4, the lower end portion of the male member is cylindrical in form and includes an outer circumferentially extending continuous surface up to the area 48 where the surface is interrupted by a plurality of slots 55. The slots 55 form a plurality of circumferentially disposed, upwardly extending fingers 50 therebetween having a series of teeth in the form of, for example, a threaded surface 52, on the outer wall thereof. As seen in FIGS. 2A and 2B, the inner surface 54 of the female member and the outer surface 56 of the male member are sealed together by the illustrated O-ring 57 (FIG. 4) placed therebetween. The slots commence above the O-ring and below the teeth 52, and extend through the upper end 58 of the male member.

An inner sleeve 60 is threadedly secured to and forms an integral part of the male member and is spaced inwardly from the continuous cylindrical wall and upwardly extending fingers of the male member so as to form an annular working chamber 62 therebetween. Numeral 64 indicates the upper end of the annular working chamber 62. A nose piece 66 on the upper end of sleeve 60 is slidably received within the interior of the upper portion of the female member and provides a closure for the upper end 64 of the working chamber 62. The nose piece and sleeve abuttingly engage one another at shoulder 72. The bore 68 of nose piece 66 is conical in shape, narrowing the longitudinal axial passageway therethrough from top to bottom, and is flush with the bore of sleeve 60 at the point where they adjoin.

A bleed port 74 extends from the longitudinal axial passageway 99 at the interior of the releasable coupling of the invention into the lower end portion of the working chamber 62. A pilot passageway 76 extends from such longitudinal passageway 99 into the upper end portion 64 of the annular working chamber 62. An annular cylindrical piston 78 is reciprocatingly received within annular working chamber 62 and divides the working chamber into an upper and lower annular area. The outer surface 80 of piston 78 sealingly engages the inner continuous surface area of male member 44 by means of O-ring 88 carried by the piston. The inner surface 82 of the piston sealingly engages the outer surface of the sleeve by means of O-ring 90 carried by the sleeve. The lower end 84 of piston 78 is disposed within the lower part of the working chamber, while the upper end of the piston is disposed within the upper part of the working chamber. A shear pin 86 is disposed in a transverse channel formed through the wall of piston 78, with the end of pin 86 being disposed in a blind bore formed in the outer wall of sleeve 60, to maintain the piston firmly secured into proper position, i.e., toward the upper end of the working chamber, until sufficient force has been applied to the piston to cause the pin 86 to shear. It is not necessary to have more than one shear pin, but two or more may be employed.

O-rings 88 and 90 prevent fluid flow from the upper portion of the annular working chamber into the lower portion of the annular working chamber. Numeral 92 indicates the lower conical shaped interior of the male member which enlarges in a downward direction.

The longitudinal axial passageway 99 of the releasable coupling of the invention tapers inwardly or narrows in inside diameter from top to bottom, that is, passageway 99 is wider at the location indicated by the arrows 96 than it is at the location indicated by arrows 94. A sealing member such as ball 98 is of a diameter intermediate the diameters of passageway 99 indicated at locations 94 and 96, so that when the ball is dropped down the tubing string 14, it comes to rest in seated relationship within passageway 99 at a location intermediate locations 94 and 96, for example as shown in FIG. 2B. In one embodiment of the invention, for example, passageway 99 near the upper end of inner sleeve 60 is about 1.875 inches in inside diameter and remains at approximately that dimension for a substantial portion of the length of the sleeve. Near the bottom of the passageway 99, below shear pin 86 and above the lower end of sleeve 60, the inside diameter of the bore 99 narrows relatively abruptly to approximately 1.812 inches. When a ball 98 having a diameter of about 1.875 inches is dropped through the bore, it tends to begin seating in the axial bore near the upper end of the sleeve. When the ball reaches the area of the 1.812-inch inside diameter, the ball 98 becomes securely seated in bore 99. Although the sealing member is a ball or sphere in the preferred embodiment, the sealing member may have any shape which is necessary to seal off passageway 99.

In operation, the tool of the first embodiment of the present invention is assembled in the configuration shown in the drawings, particularly in FIGS. 2A and 2B, and can be interposed within the pipe or tubing string 14 at a location such as is illustrated in FIG. 1. When it is desired to release the lower end of the string and drop the released part downhole, sealing member or ball 98 is released or dropped or otherwise moved down the interior of the string 14 until it comes to rest in passageway 99 between pilot passageway 76 and bleed port 74 such as is shown in FIG. 2B. The ball 98 does not have to form a perfect seal with bore 99 in order for the releasable coupling of the invention to operate. Thus, the bore 99 can be made to have a standard, relatively smooth, machined finish, and no special finishing or tooling is required for the bore. The ball can be made of any of a variety of materials, but preferably is made of steel or the like. A ball made of steel or equivalent material has sufficient weight to enable it to roll down the wellbore regardless of the shape of the wellbore to become seated in bore 99. It should be noted that ball 98 generally will not be rolling down the borehole against flowing fluid. When the well has been perforated with the perforating gun, it is preferred to shut in the well prior to actuating the releasable coupling of the invention to release the lower portion of the tubing string. When the well is shut in, the well fluids become static once the stable shut-in pressure is reached. At this point, the ball 98 can be dropped into the well and it will fall by gravity through the pressurized, non-flowing or static well fluids. Although it is possible to pump the ball down the wellbore into the releasable coupling, this is not preferred because it would require pumping fluids from the surface into the formation being produced. Such a procedure is undesirable because mud or debris or other material might be forced into tunnels 36, preventing or obstructing free flow of fluids from the formation to the surface.

Once ball 98 is seated in passageway 99, pressure above the shut-in pressure is applied through passageway 99 by means of tubing string 14, thereby effecting a pressure differential across the ball. Even when the well is shut in, when pressure above the shut-in pressure is applied down the tubing from the surface, for example with a pump, additional fluids might have to be pumped into the tubing in order to accommodate tubing expansion. For example, it might take one-half of a barrel of fluid added at the surface in order to accommodate expansion of about 8,000 feet of tubing above the ball 98. The fluid pressure communicates with the upper end 64 of the working chamber 62 by means of pilot passageway 76. When the force applied to the top of piston 78 reaches a magnitude sufficient to shear pin 86, the piston is forced to move downwardly into the lower portion of the working chamber 62, as seen in FIG. 2B. Face 84 of the piston abuttingly engages annular shoulder or face 85 formed at the bottom of the upwardly opening working chamber 62, thereby providing a limit to the downward piston travel. The amount of pressure above the shut-in pressure required to release the coupling of the invention is dependent in part upon the strength of shear pins 86. In some cases, shear pins 86 will have a low-pressure rating such that only a relatively small pressure is required to shear them and release the coupling. The shear pins should, however, be strong enough to withstand some accidental abuse or misuse during handling, such as dropping the tool a distance of up to about six feet, without shearing. This would avoid the tool's being prematurely released by reason of mishaps of this nature that the tool sometimes experiences in service. If there is an imperfect seal between ball 98 and bore 99, for example, if about one-half barrel of fluids were being lost past the ball per minute, the pressure required to shear pins 86 can be reached simply by increasing the pumping rate from the surface. In some applications of the present invention, for example, shut-in pressure will be about 1,000 p.s.i., and an additional 1,700 p.s.i. is effected across the ball 98 and piston 78 in order to shear pins 86.

When the piston is forced downwardly, away from the threadedly engaged portions of the fingers and the female member, the fingers are free to move inwardly toward the sleeve 60. The additional pressure being applied through the tubing string from the surface acts upon the entire surface area of the piston 78 and male member 44 between the O-ring 90 and the O-ring 57 disposed between male member 44 and female member 40, and the downward force thus applied to the male member, coupled with the weight of the tubing string below the male member, causes the teeth on fingers 50 to cam out of engagement with the teeth on the inside of the female member, the fingers being forced inwardly. These cooperating teeth are preferably designed with the requisite slope or pitch so that even if relatively little downward force on the male member is supplied by the weight of the length of tubing below the male member, the additional pressure applied from the surface that shears pins 86 effects a suficient downward force on the male member to cam the teeth on the male and female members out of engagement with each other, so that once the piston 78 is moved to its lowered position, the male member is then almost simultaneously pumped away from the female member. In many cases, however, the weight of the lower portion of the tubing string connected to the male member 44 may be as much as several thousand pounds, and this would typically be sufficient in and of itself to cam the fingers inwardly, out of engagement with the female member. It will also be appreciated that the metal ring bent into slots 45, 47 preventing relative rotation of the male and female members separates from lower end 42 as such members move axially. Accordingly, the male and female members telescope apart, and the lower end of the string falls towards the bottom of the borehole, leaving the remaining length of the string supported within the borehole. When the male member drops out from the bottom of the female member, the same pressure above the shut-in pressure that actuates the present invention can no longer be maintained, and the pressure at the surface drops sharply. Thus, the release of the tool of the present invention and the dropping away of the lower portion of the string can be readily detected at the surface by observing this sudden drop in pressure.

Figures 5A, 5B:
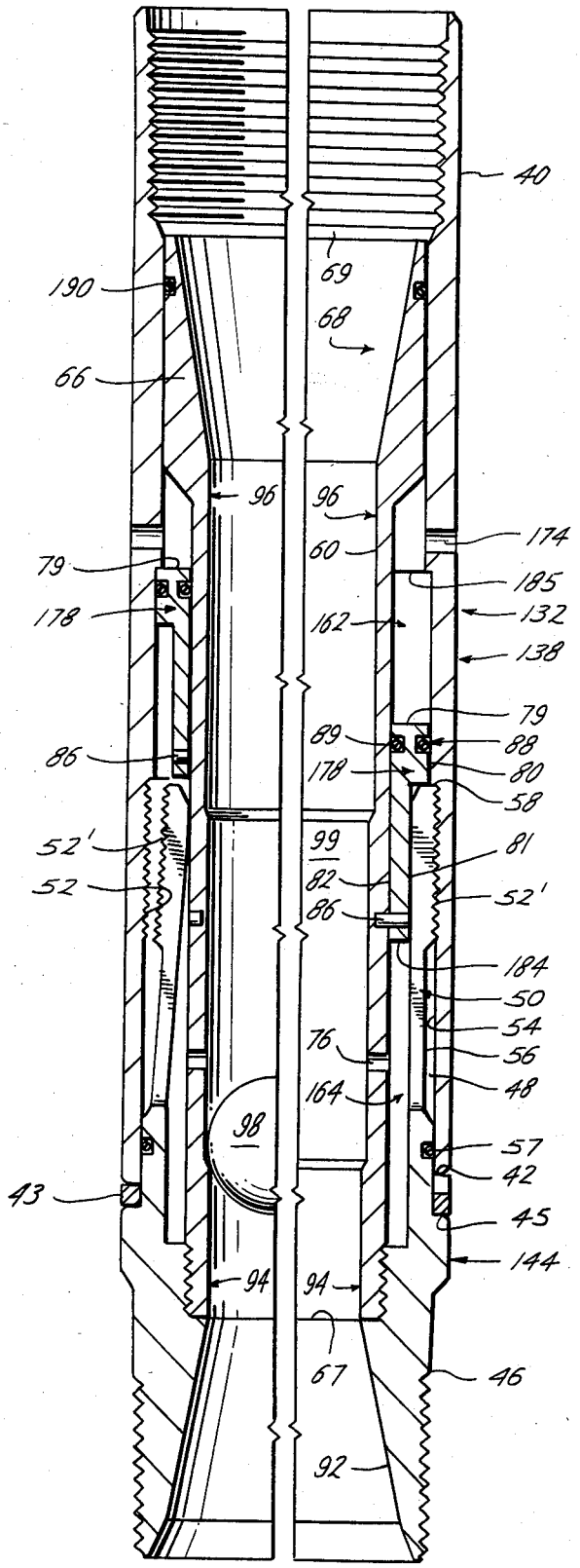
FIG. 5A is an enlarged, longitudinal, cross-sectional view of the second or alternative embodiment of the releasable coupling of the invention with the male member lockingly engaged within the female member prior to the sealing member being seated within the axial passageway of the sleeve and pressure applied through the axial passageway of the string above the releasable coupling.
FIG. 5B is an enlarged, longitudinal, cross-sectional view of the apparatus of FIG. 5A after the sealing member has been seated within the axial passageway of the sleeve and pressure applied through the axial passageway of the string above the releasable coupling, thereby driving the piston upwardly away from the teeth on the male and female members.

The second or alternative embodiment of the present invention is shown in FIGS. 5A and 5B of the drawings and illustrates another form of releasable coupling apparatus which can be interposed within a pipe or tubing string in the manner shown at 32 in FIG. 1. In FIGS. 5A and 5B, parts or elements which correspond to like parts or elements shown in the other figures are in general given like reference numerals. The second embodiment of the present releasable coupling apparatus is indicated generally at 132, and includes a main body 138, hereinafter referred to as a female member, having an upper threaded box end 40 and a lower end 42. The second embodiment of the releasable coupling apparatus of the present invention further includes a male member 144 having a threaded pin 46 at the lower end thereof, and includes a plurality of circumferentially disposed, upwardly extending fingers 50 which commence at a location generally indicated at 48 as in the manner described above with respect to the first embodiment. Coacting teeth, for example in the form of threads 52, 52', are formed on a medial portion of the inside wall surface of the main body 138 and the upper portion of the outside surface of the fingers 50, respectively. Numeral 56 generally indicates the outside surface of the individual fingers 50. O-ring 57 forms a seal between the male member 144 and the female member 138 below fingers 50. The fingers have an upper free end 58, which is also the upper terminal end of the male member.

An inner sleeve 60 is threadedly secured to and forms an integral part of the male member and is spaced inwardly from the continuous cylindrical wall and upwardly extending fingers of the male member at its lower end, and inwardly from the continuous cylindrical wall of the female member at its upper end, and forms an annular working chamber therebetween. The annular working chamber is comprised of a lower pressure chamber 162 spaced or separated from a high pressure chamber 164 by a piston 178.

The sleeve 60 enlarges into an upper nose piece 66 which is slidably received in the bore of the female member, and has a lower end 67. The nose piece 66 has an inside surface 68 which narrows downwardly in conical configuration, commencing at the upper terminal end 69 thereof and continuing to be reduced in inside diameter until it equals the inside diameter of axial passageway 99.

The male and female members are prevented from rotating with respect to each other by a metal ring 43 and slots 45, 47 as in the case of the first embodiment of the invention.

The female member 138 is provided with a low pressure port 174 which comunicates the upper annular chamber 162 with the annulus of the well. The sleeve 60 is provided with a pilot passageway 76 therethrough which communicates the lower annular chamber 164 with the interior of the tubing string. The annular piston 178 includes an upper enlargement or boss portion 80 having an upper end 79 and a reduced diameter portion 81 below the boss. The inside surface of piston 178 is slidably disposed on sleeve 60 in close tolerance relationship therewith. The outside surface of the boss 80 is slidably received within the inside surface of the female member in close tolerance relationship therewith, and the outside surface of the reduced diameter portion 81 is slidably received within or against the inside wall surface of the fingers. The lower end of the piston is indicated generally at 184.

An annular shoulder 185 is formed on the interior of the female member and abuttingly receives the upper face 79 of the piston when the piston is reciprocated into its uppermost position of travel as seen in FIG. 5B.

A shear pin 86 is disposed in an aperture through the wall of the reduced diameter portion 81 and in a blind bore in the sleeve 60. Shear pin 86 is sized to releasably hold the piston to the sleeve inwardly of the fingers as shown in FIG. 5A until it is desired for the piston to be moved away from the fingers into the position shown in FIG. 5B.

The piston is provided with grooves in the outside and inside walls of boss 80, in which are disposed O-rings 88 and 89, respectively. An upper O-ring 190 disposed in a groove in the outside wall of nose piece 66 prevents fluid flow between the nose piece and the inside surface of the female member. The lower inside surface 92 of the axial passageway 99 is conical in configuration and broadens downwardly. The inside diameters 94 and 96 of the passageway 99, along with the outside diameter of ball 98, are each selected in the same manner as previously described above in conjunction with the first embodiment of the present invention.

In operation, usually after the bar 36 of FIG. 1 has been dropped and the jet perforating gun 28 has perforated the well, the well will be shut in as described above, and a ball 98 dropped downhole into the axial passageway 99 of the releasable coupling. As shown in FIG. 5B, the ball will become seated in the axial passageway 99 below pilot port 76, whereupon fluid flow through the axial passageway of the releasable coupling is precluded. When pressure is effected within the tubing string by introducing compressible or non-compressible fluids at the surface, face, flow can occur through port 76 and this pressure is communicated into the high pressure chamber 164, thereby providing upthrust or upwardly directed force against the lower face 184 of the piston. When this force provides a pressure differential across the piston which exceeds the structural integrity of shear pin 86, the piston is forced upwardly until face 79 is abutted against shoulder 185, as shown in FIG. 5B. This action removes the restraining member which holds teeth 52, 52′ engaged with one another, and the downward force acting on the male member, including that resulting from the pressure applied from the surface and that resulting from the weight of the string below the male member, causes the teeth, or threads, to cam out of engagement with each other as seen in FIG. 5B. This action enables metal ring 43 to separate from slots 45, 47 and the male member to telescopingly slide from the female member, taking with it the sleeve, ball, and piston. The female member and tubing attached to it are left supported in the well bore.

The male member and the tubing and tools attached to it then fall down into the well, and can be fished from the well at a later time if necessary by engaging the nose piece 66 with a suitable fishing tool.

The second embodiment of the present invention illustrated in FIGS. 5A and 5B can be employed in wells where the inside diameter of the casing is smaller than that which will accommodate the first embodiment, since the outside diameter of the second embodiment of the invention can be made smaller than is possible with the first embodiment of the invention.

In the first embodiment of the present invention, the piston is forced to move downhole, and the fluid displaced from the lower chamber 62 is expelled into the axial passageway below the ball. The second embodiment of the invention disclosed in FIGS. 5A and 5B causes the fluid displaced by the piston to be expelled directly into the annulus. In instances where a circulation port 33 is provided below the ball actuated releasable coupling, the effect of the displaced fluid from either embodiment of the present invention is identical.

The apparatus of the second embodiment of the invention is substantially immune to being inadvertently opened by shock so long as the tool is held in the upright position. This is because any large impact received by accidentally dropping the tool, when the tool is in the upright position, forces the lower annular surface of the piston boss against the upper end of shoulder 58 of the male member.

While a preferred embodiment of the invention has been shown and described, modifications thereof can be made by one skilled in the art without departing from the spirit of the invention.

I claim:

1. A ball actuated, releasable coupling apparatus which can be interposed within a tubing string for subsequently parting one length of the string from another, comprising:

a female member having an end adapted for attachment into an upper length of the tubing string;

a male member having an end adapted for attachment into a lower length of the tubing string;

a lower length of said female member and an upper length of said male member being of relative diameters which permits telescopingly joining one within the other;

a sleeve connected to a lower portion of said male member and extending upwardly in spaced relationship with respect to said upper length of said male member;

a releasing piston having an outer surface for slidably engaging the inner surface of said male member and an inner surface for slidably engaging the outer surface of said sleeve, said piston being movable from a first postion to a second position;

said female member, said male member, said releasing piston and said sleeve being concentrically arranged with respect to one another, there being an axial passageway through said female member, said male member, said releasing piston and said sleeve, said releasing piston being slidably received within at least a portion of said lower length and upper length, respectively, of said female and male members, respectively;

a plurality of circumferentially spaced, upwardly extending fingers formed in said upper length of said male member, said outer surface of said releasing piston bearing against the inner surface of said fingers to secure said fingers against a medial length of said female member when said piston is in said first position;

the outer surface of said fingers and said medial length of said female member having coacting teeth formed thereon which mutually engage one another;

said piston allowing said fingers to resistingly move inwardly towards one another when said piston is in said second position such that the teeth become disengaged from one another, whereupon said male and female members slide apart from one another, thereby releasing said male and female members from one another.

2. The releasable coupling apparatus of claim 1 wherein said fingers are formed by a plurality of circumferentially spaced slots which extend from the upper terminal end of said male member to a location spaced below said teeth formed on the outer surface of said fingers to enable the entire toothed surface of each finger to be moved radially inward towards the axial centerline of the male member a distance sufficient to enable the coacting toothed surfaces to mave laterally with respect to one another.

3. The releasable coupling apparatus of claim 1 wherein said fingers are parallel to one another and to the longitudinal central axis of said male and female members; and said fingers have sidewalls formed by slots which extend a distance substantially greater than the toothed area formed on said fingers to enable the toothed portion of said fingers to be yieldably forced towards one another an amount which is greater than the depth of said teeth, whereby sliding telescoping movement between said male and female members is permitted when said piston is moved into said second position away from contact with said fingers.

4. The releasable coupling apparatus of claim 1, wherein said sleeve forms a working chamber with said male and female members within which said piston is reciprocatingly received;

a pilot passageway is formed through one end of said sleeve communicating such axial passageway with one end of said working chamber;

a bleed port is formed through one of the walls of the working chamber at the other end thereof; and the inner wall surface of said sleeve converges in a downward direction, so that a ball can be seated within such axial passageway of sald sleeve below said pilot passageway and pressure applied to the ball, thereby subjecting the end of said piston disposed in said one end of said working chamber to the pressure drop across the ball.

5. A releasable, sealed, fluid conveying coupling apparatus having opposite ends adapted for connection into a tool string so that the tool string can subsequently be parted and having an axial passageway therethrough, comprising:

a female member which telescopingly receives a length of a male member;

said male member including in said length received in said female member a plurality of fingers which are circumferentially arranged in spaced apart relationship and can be forced to yieldably move inward towards one another;

means forming a plurality of teeth on the inner surface of said female member and means forming a plurality teeth on the outer surface of an end portion of said fingers, the teeth means of said male and female members being engageable with one another;

a sleeve connected in spaced relationship to said male and female members to form a working chamber;

a piston reciprocatingly received within the working chamber and movable from a first position slidably received within the end portion of said fingers having said teeth to prevent the fingers from moving radially inwards and to maintain the teeth in engagement with one another to a second position away from said end portion of said fingers to enable said fingers to move radially inwards and enable said teeth to become disengaged from one another;

so that when said piston in moved into said second position away from the fingers and said male and female members are pulled apart with sufficient force, the teeth on said male and female members move laterally with respect to each other to cause the male member to be released from the female member.

6. The apparatus of claim 5 wherein said fingers are formed by a plurality of circumferentially spaced slots which extend from the upper terminal end of said male member to a location spaced from said teeth formed on the outer surface of said fingers, to enable the entire toothed surface of each finger to be moved radially towards the axial centerline of the male member a distance sufficient to enable the coacting toothed surfaces to move laterally with respect to one another.

7. The apparatus of claim 5 wherein said fingers are parallel to one another and to the longitudinal central axis of said male and female members;

said fingers have sidewalls formed by spaced slots which extend a distance substantially greater than the toothed area formed on said fingers to thereby enable the toothed portions of said fingers to be yieldably forced towards one another an amount which is greater than the depth of said teeth, to permit sliding telescoping movement between said male and female members when said piston is moved from said first position to said second position.

8. The apparatus of claim 6 wherein a pilot passageway is formed through one end of said sleeve communicating the axial passageway with one end of the working chamber;

a bleed port is formed through one of the walls of the working chamber at the other end thereof; and the inner wall surface of said sleeve converges in a downward direction so that a ball can be seated within the axial passageway of the sleeve below said pilot passageway and pressure applied to the ball, thereby subjecting said piston to the pressure drop across the ball.

* * * * *